US011536149B1

(12) United States Patent
Mizukami et al.

(10) Patent No.: US 11,536,149 B1
(45) Date of Patent: Dec. 27, 2022

(54) COOLING METHOD AND STRUCTURE OF VANE OF GAS TURBINE

(71) Applicant: MITSUBISHI HEAVY INDUSTRIES, LTD., Tokyo (JP)

(72) Inventors: Satoshi Mizukami, Houston, TX (US); David Allen Flodman, Houston, TX (US); Satoshi Hada, Houston, TX (US)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/692,667

(22) Filed: Mar. 11, 2022

(51) Int. Cl.
*F01D 9/06* (2006.01)
*F01D 9/04* (2006.01)

(52) U.S. Cl.
CPC ..... *F01D 9/065* (2013.01); *F01D 9/041* (2013.01)

(58) Field of Classification Search
CPC ..... F01D 5/188; F01D 5/186; F01D 5/189; F01D 5/288; F01D 9/02; F01D 9/065; F01D 9/041; F01D 2260/202; F02D 7/18; F05D 2240/81; F05D 2260/201
See application file for complete search history.

(56) References Cited

U.S. PATENT DOCUMENTS 3,767,322 A * 10/1973 Durgin ..... F01D 5/189 415/115
2002/0090294 A1* 7/2002 Keith ..... F01D 9/04 415/115
2008/0317585 A1* 12/2008 Lee ..... F01D 5/189 60/39.83
2015/0211376 A1* 7/2015 Riley ..... F01D 5/186 415/115
2016/0363053 A1* 12/2016 Miranda ..... F01D 5/187
2017/0101894 A1* 4/2017 Preethi ..... F01D 5/189
2018/0010483 A1* 1/2018 Beach ..... F01D 5/188
2018/0142559 A1* 5/2018 Coomer ..... F01D 5/187
2020/0190989 A1 6/2020 Fujii et al.

FOREIGN PATENT DOCUMENTS

JP 6799702 B1 12/2020
WO 2019/003590 A1 1/2019

* cited by examiner

*Primary Examiner* — Igor Kershteyn
(74) *Attorney, Agent, or Firm* — WHDA, LLP

(57) ABSTRACT

A method of cooling a vane of a turbine is provided. The turbine includes an airfoil, a shroud disposed at an end of the airfoil, the end being a radial end along a radial direction of the turbine, the shroud comprising a shroud main body and a shroud edge disposed on a circumference of the shroud main body to surround the shroud main body, the shroud edge comprising a shroud edge passage therein. A cooling air is caused to flow inside the shroud edge passage to cool the shroud edge, and after cooling the shroud edge, the shroud main body is cooled by using the cooling air which has flowed inside the shroud edge passage.

20 Claims, 12 Drawing Sheets

COOLING METHOD AND STRUCTURE OF VANE OF GAS TURBINE

TECHNICAL FIELD

The present disclosure relates to a cooling method of a stator vane of a gas turbine, and also relates to a cooling structure of a stator vane of a gas turbine.

BACKGROUND

A stator vane of a gas turbine and a rotor blade of the gas turbine are exposed to high temperature combustion gas. Thus, the stator vane and the rotor blade are cooled by cooling air. FIG. 1 schematically illustrates a conventional structure for cooling an airfoil of a stator vane of a gas turbine. For example, in the conventional structure for cooling the airfoil of the vane of the gas turbine, as shown by FIG. 1, cooling air which is supplied to an insert of the air foil of the first stage vane is jetted from apertures provided to the insert toward an inner surface of the airfoil for impingement cooling of the inner surface of the airfoil, and then, is ejected through holes in the airfoil to result in a film of cooling air flowing along the external surface of the airfoil. In other words, the cooling air which is used for impingement cooling is ejected through the holes to a hot gas passage (the ejection of the cooling air is described by arrows in FIG. 1).

FIG. 2 schematically illustrates a conventional structure for cooling a shroud of a gas turbine. A stator vane includes a shroud structure which is cooled by cooling air. As shown by FIG. 2, cooling air is taken from a shroud body to a side edge portion of the shroud (shroud edge) and flows along the side edge portion of the shroud toward a trailing edge portion of the shroud. The cooling air used for cooling the shroud edge is ejected to the hot gas passage from the trailing edge portion of the shroud (the ejection of the cooling air is described by arrows in FIG. 2).

SUMMARY

Recently, gas turbine inlet temperature is increased, and thus, it is desirable to further facilitate cooling of the first stage stator vane. One of approaches to address the above is to supply cooling air with higher pressure and lower temperature (compared to conventional technology) to the first stage stator vane. According to the study by inventors, in a case when the cooling air with higher pressure and lower temperature is used for cooling the first stage stator vane, even after the cooling air is used for cooling an airfoil or a shroud edge, there is a possibility that the cooling air may be re-used for cooling other elements or components of the first stage stator vane. However, in the conventional technology, in the first stage stator vane, the cooling air should be ejected to a hot gas passage. Therefore, efficiency of use of the cooling air is limited.

It is desirable to provide a cooling method or cooling structure of a stator vane of a gas turbine which enables better efficiency of use of cooling air.

According to a first aspect of the present disclosure, there is provided a method of cooling a vane of a turbine, the turbine comprising an airfoil, a shroud disposed at an end of the airfoil, the end being a radial end along a radial direction of the turbine, the shroud comprising a shroud main body and a shroud edge disposed on a circumference of the shroud main body to surround the shroud main body, the shroud edge comprising a shroud edge passage therein. The method comprises steps of:

(i) causing a cooling air to flow inside the shroud edge passage to cool the shroud edge; and (ii) after cooling the shroud edge, cooling the shroud main body by using the cooling air which has flowed inside the shroud edge passage.

With the above-described feature, the cooling air used for cooling the shroud edge may be used for cooling other components of the stator vane such as the shroud main body without ejecting the cooling air into a hot gas passage. Thus, it becomes possible to improve efficiency of use of cooling air. Moreover, the shroud edge which is susceptible to hot gas temperature may be cooled first with the cooling air of lower temperature. Then, the cooling air may be used for cooling the shroud main body which is less susceptible to hot gas temperature. Thus, it becomes possible to improve efficiency of use of cooling air.

In the first aspect, the method may further comprises causing the cooling air to flow inside the airfoil to cool the airfoil, and wherein the step (i) further comprises causing the cooling air to flow inside the shroud edge passage to cool the shroud edge by using the cooling air which has flowed inside the airfoil after cooling the airfoil. With the above-described feature, the cooling air used for cooling the airfoil may be used for cooling other components of the stator vane such as the shroud edge without ejecting the cooling air into a hot gas passage. Thus, it becomes possible to improve efficiency of use of cooling air.

According to a second aspect of the present disclosure, there is provided a method of cooling a vane of a turbine, the turbine comprising an airfoil, a shroud disposed at an end of the airfoil, the end being a radial end along a radial direction of the turbine, the shroud comprising a shroud main body and a shroud edge disposed on a circumference of the shroud main body to surround the shroud main body, the shroud edge comprising a shroud edge passage therein. The method comprises steps of:

(i) causing a cooling air to flow inside the airfoil to cool the airfoil;

(ii) after cooling the airfoil, cooling either one of the shroud main body or the shroud edge by using the cooling air which has flowed inside airfoil; and (iii) after cooling either one of the shroud main body or the shroud edge, cooling the other one of the shroud main body or the shroud edge by using the cooling air which has cooled either one of the shroud body or the shroud edge.

With the above-described feature, the cooling air used for cooling the airfoil may be used for cooling other components of the stator vane such as the shroud edge and the shroud main body without ejecting the cooling air into a hot gas passage. Thus, it becomes possible to improve efficiency of use of cooling air. Moreover, the shroud edge which is susceptible to hot gas temperature may be cooled first with the cooling air of lower temperature. Then, the cooling air may be used for cooling the shroud main body which is less susceptible to hot gas temperature. Thus, it becomes possible to improve efficiency of use of cooling air.

According to a third aspect of the present disclosure, there is provided a vane of a turbine comprises an airfoil; and a shroud disposed at an end of the airfoil, the end being a radial end along a radial direction of the turbine. The shroud comprises: a shroud main body comprising a first wall facing a hot gas passage of the turbine, a second wall disposed on an opposite side of the first wall with respect to the hot gas passage, and a shroud edge disposed on a circumference of the shroud main body to surround the shroud main body, the shroud edge comprising a shroud edge passage therein. The shroud edge comprises a cooling air inlet to introduce a cooling air into the shroud edge passage and a cooling air outlet to cause the cooling air to flow out of the shroud edge passage. The shroud main body comprises a hollow space inside thereof between the first wall and the second wall, the hollow space being connected with the shroud edge passage through the cooling air outlet.

With the above-described feature, the cooling air introduced into the shroud edge passage through the cooling air inlet and used for cooling the shroud edge may flow into the hollow space of the shroud main body through the cooling air outlet and used for cooling the shroud main body without ejecting the cooling air into a hot gas passage. Thus, it becomes possible to improve efficiency of use of cooling air. Moreover, the shroud edge which is susceptible to hot gas temperature may be cooled first with the cooling air of lower temperature. Then, the cooling air may be used for cooling the shroud main body which is less susceptible to hot gas temperature. Thus, it becomes possible to improve efficiency of use of cooling air.

BRIEF DESCRIPTION OF THE DRAWINGS

The advantages of the disclosure will become apparent in the following description taken in conjunction with the following drawings.

DESCRIPTION OF THE PREFERRED EMBODIMENTS

Figure 1:
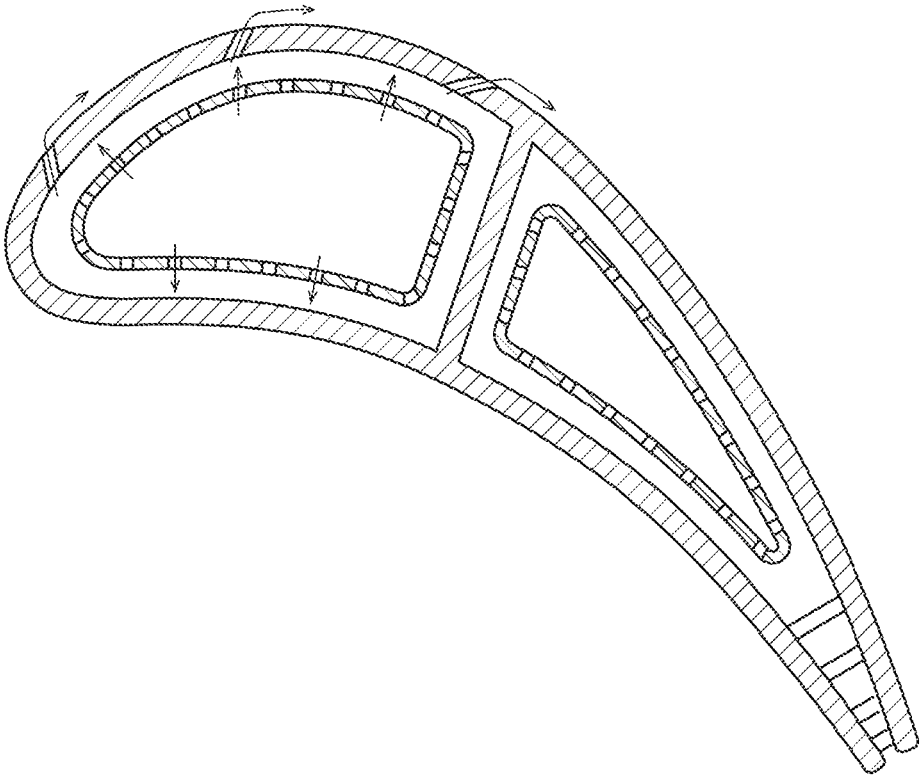
FIG. 1 PRIOR ART
FIG. 1 schematically illustrates a conventional structure for cooling an airfoil of a stator vane of a gas turbine.
Figure 2:
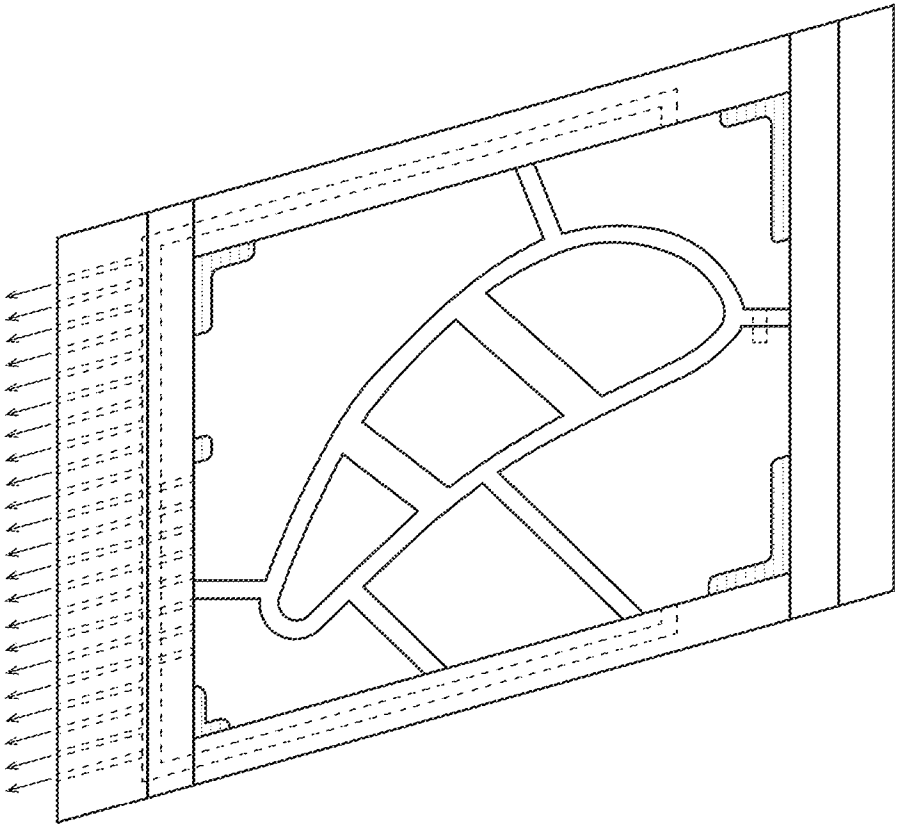
FIG. 2 PRIOR ART
FIG. 2 schematically illustrates a conventional structure for cooling a shroud of a stator vane of a gas turbine.
Figure 3:
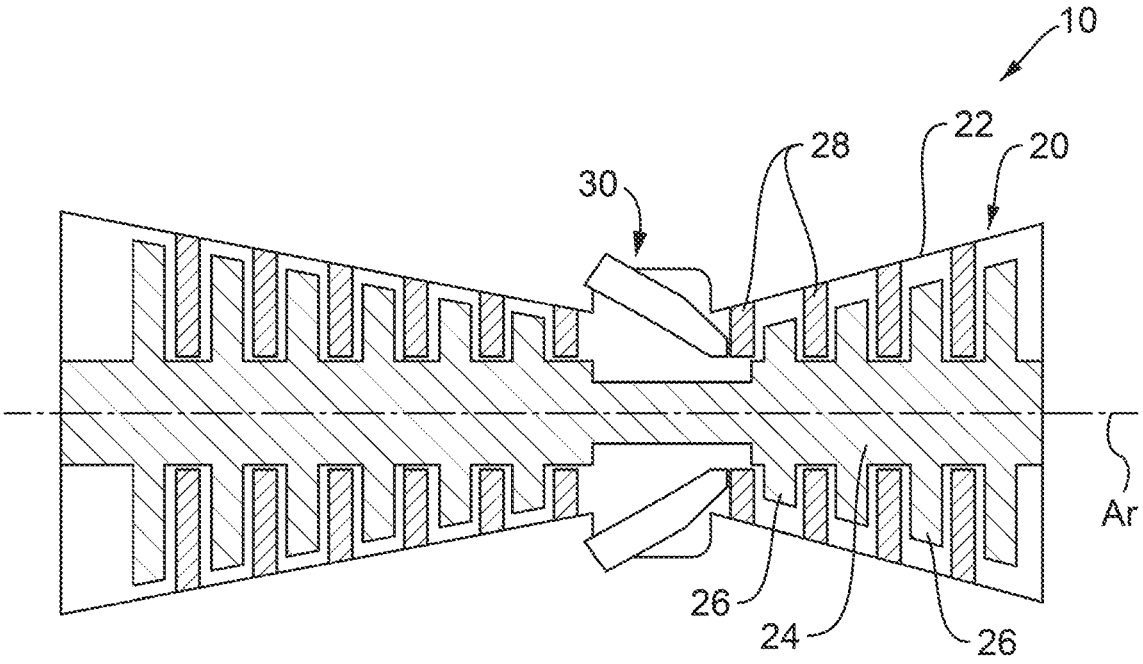
FIG. 3 is a schematic sectional view of a gas turbine in an embodiment according to the present disclosure.

A preferred embodiment of the present disclosure will be described in detail below with reference to the drawings. FIG. 3 is a schematic sectional view of a gas turbine in an embodiment according to the present disclosure. As shown in FIG. 3, a gas turbine 10 of this embodiment includes a turbine 20 driven by combustion gas generated by a combustor 30. The turbine 20 has a rotor shaft 24, a turbine rotor 26 that rotates around an axis Ar, a turbine casing 22 that covers the turbine rotor 26, and a plurality of stator vane stages 28.

Figure 4:
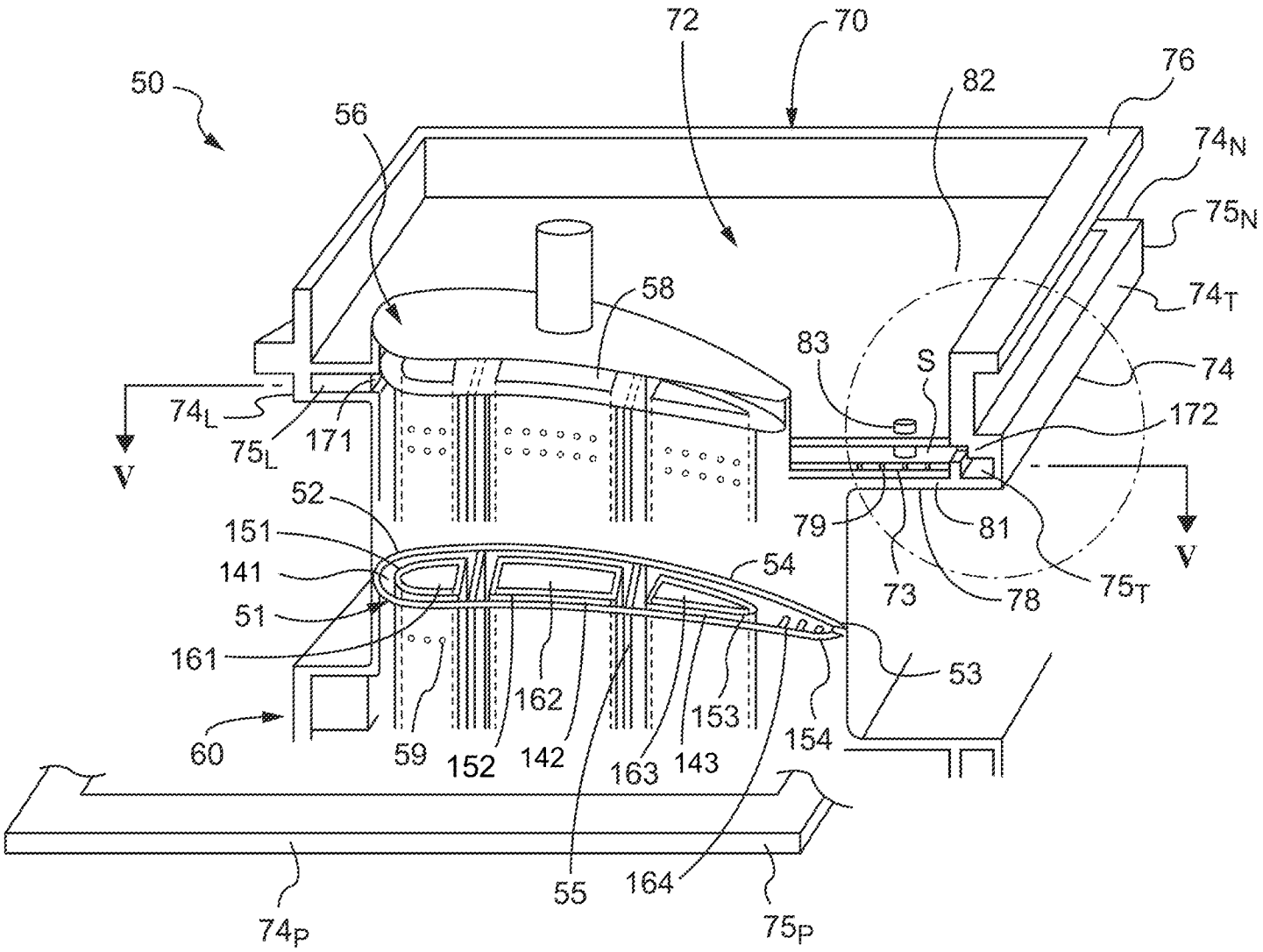
FIG. 4 is a perspective view of a stator vane in a first embodiment.
Figure 5:
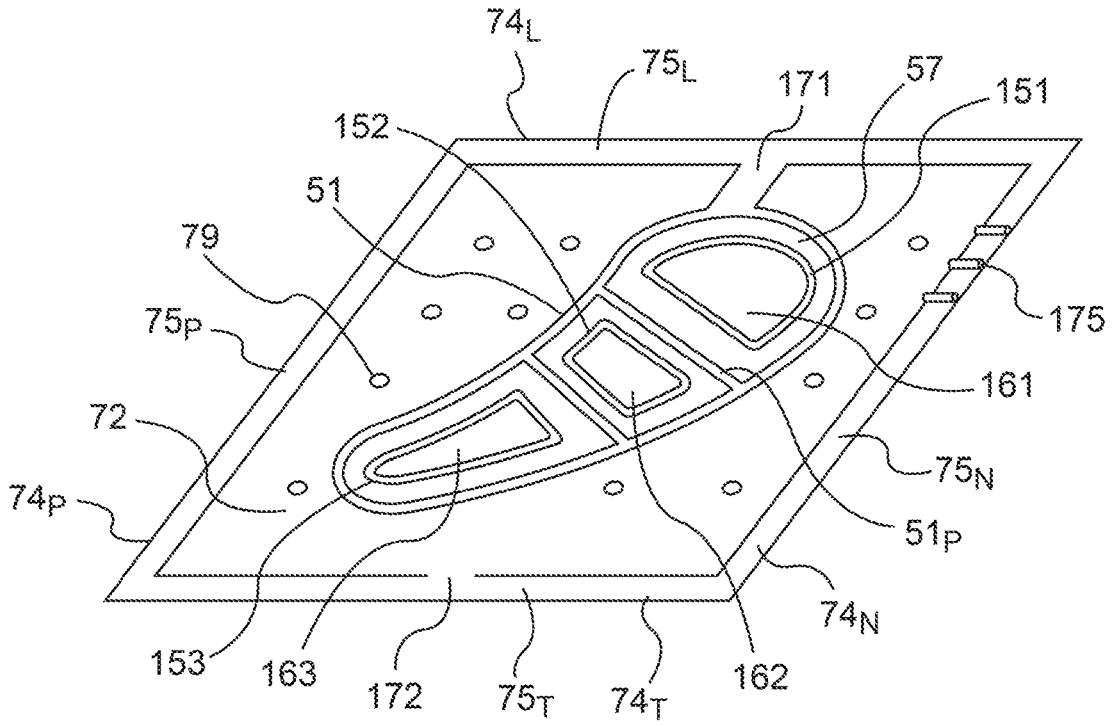
FIG. 5 is a sectional view taken along the line V-V of FIG. 4.
Figure 6:
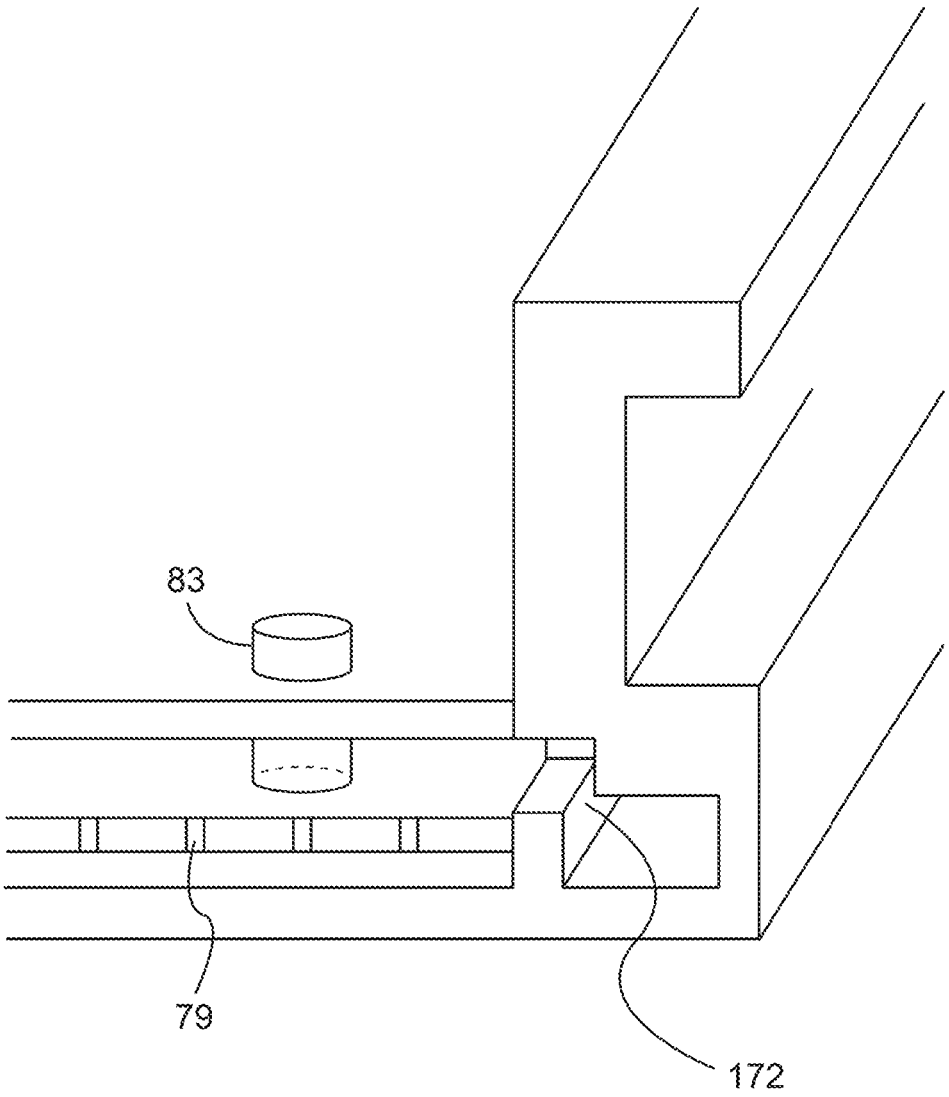
FIG. 6 is a partial enlargement view of the stator vane.

FIG. 4 schematically illustrates a stator vane of a gas turbine according to an embodiment of the present disclosure. FIG. 4 is a perspective view of a stator vane in a first embodiment. FIG. 5 is a sectional view taken along the line V-V of FIG. 4. FIG. 6 is a partial enlargement view of the stator vane. As shown in FIG. 4, a stator vane 50 includes a vane body (airfoil) 51 extending in a radial direction of a gas turbine, an inner shroud 60 disposed on the radially inner side of the vane body 51, and an outer shroud 70 disposed on the radially outer side of the vane body 51. The vane body 51 is disposed in a combustion gas flow passage (hot gas passage) through which the combustion gas passes. Generally, an annular combustion gas flow passage is defined by the inner shroud 60 on the radially inner side thereof and by the outer shroud 70 on the radially outer side thereof. The inner shroud 60 and the outer shroud 70 are plate-shaped members which define a part of the combustion gas flow passage.

As shown in FIG. 4, an end of the vane body 51 on the upstream side has a leading edge 52, and an end of the vane body 51 on the downstream side has a trailing edge 53. Among surfaces of the vane body 51, a convex surface is a suction-side surface 54 (negative pressure surface) and a concave surface is a pressure-side surface 55 (positive pressure surface). For the convenience purpose, in the following descriptions, the pressure side (positive pressure-surface side) of the vane body 51 and the suction side (negative pressure-surface side) of the vane body 51 will be referred to as a pressure side and a suction side, respectively.

The inner shroud 60 and the outer shroud 70 have basically the same structure. Therefore, the outer shroud 70 will be described primarily below.

As shown in FIG. 4 and FIG. 5, the outer shroud 70 is a plate-shaped shroud member which comprises a shroud main body 72, a shroud edge 74 disposed on a circumference of the shroud main body 72, and a peripheral wall 76 that extends along the shroud edge 74 and protrudes from the shroud main body 72 toward the radially outer side of the gas turbine.

The outer shroud 70 has a leading end surface being an end surface on the upstream side, a trailing end surface being an end surface on the downstream side, a pressure-side end surface being an end surface on the pressure side, a suction-side end surface being an end surface on the suction side. The outer shroud 70 has a gas path surface 78 facing the radially inner side and facing the hot gas passage. The leading end surface and the trailing end surface are substantially parallel to each other. The pressure-side end surface and the suction-side end surface are substantially parallel to each other. Thus, when seen from the radial direction, the outer shroud 70 has a substantially parallelogram shape as shown in FIG. 5.

The shroud edge 74 is a brim or rim shaped structure projecting from the shroud main body 72. The shroud edge 74 includes a leading-side shroud edge $\mathbf{74}_L$, disposed on the upstream side of the outer shroud 70, a trailing-side shroud edge $\mathbf{74}_T$ disposed on the downstream side of the outer shroud 70, a suction-side shroud edge $\mathbf{74}_N$ disposed on the suction side of the outer shroud 70, and a pressure-side shroud edge 74*p* disposed on the pressure side of the outer shroud 70. For example, as shown by FIG. 5, the leading-side shroud edge $\mathbf{74}_L$, the trailing-side shroud edge $\mathbf{74}_T$, the suction-side shroud edge $\mathbf{74}_N$, and the pressure-side shroud edge $\mathbf{74}_P$ are disposed on a circumference of the shroud main body 72 to entirely surround the shroud main body 72.

The leading-side shroud edge $\mathbf{74}_L$ includes a leading-side shroud edge passage $\mathbf{75}_L$ inside thereof. The trailing-side shroud edge $74_T$ includes a trailing-side shroud edge passage $75_T$ inside thereof. The suction-side shroud edge $74_N$ includes a suction-side shroud edge passage $75_N$ inside thereof. The pressure-side shroud edge $74_P$ includes a pressure-side shroud edge passage $75_P$ inside thereof.

In this embodiment, the leading-side shroud edge passage $75_L$ is communicated with the suction-side shroud edge passage $75_N$ at one end thereof and communicated with the pressure-side shroud edge passage $75_P$ at the other end thereof. The trailing-side shroud edge passage $75_T$ is communicated with the suction-side shroud edge passage $75_N$ at one end thereof and communicated with the pressure-side shroud edge passage $75_P$ at the other end thereof. As shown by FIG. 4, FIG. 5 and FIG. 6, the leading-side shroud edge passage $75_L$ has a shroud edge passage inlet 171. The trailing-side shroud edge passage $75_T$ has a shroud edge passage outlet 172. Part of cooling air which flows into the leading-side shroud edge passage $75_L$ through the shroud edge passage inlet 171 flows through the suction-side shroud edge passage $75_N$ and the pressure-side shroud edge passage $75_P$, then flows through the trailing-side shroud edge passage $75_T$, and then, flows out from the shroud edge passage outlet 172. As shown by FIG. 5, the shroud edge passages $75_L$, $75_T$, $75_P$, $75_N$ include turbulators 175. The turbulator 175 may be a rib disposed on an inner surface of the shroud edge passages. To enhance cooling of the shroud edge, the turbulator 175 may be disposed on a bottom surface of the passage which defines a radially inner side of the passage. Here, the bottom surface of the passage may be extended substantially parallel to the radially inner wall 81. Also, the turbulator 175 may be disposed on a side surface of the passage which defines an outer lateral side of the passage.

In the present embodiment, the shroud edge passage inlet 171 is provided to the leading-side shroud edge passage $75_L$ and the shroud edge passage outlet 172 is provided to the trailing-side shroud edge passage $75_T$. However, the structure of the stator vane is not limited to this embodiment. The shroud edge passage inlet 171 may be provided to other shroud edge passage such as the suction-side shroud edge passage $75_N$, the pressure-side shroud edge passage $75_P$, or the trailing-side shroud edge passage $75_T$. The shroud edge passage outlet 172 may be provided to other shroud edge passage such as the suction-side shroud edge passage $75_N$, the pressure-side shroud edge passage $75_P$, or the leading-side shroud edge passage $75_L$. Alternatively, a plurality of the shroud edge passage inlets 171 may be provided to either one or more of the shroud edge passages $75_L$, $75_T$, $75_N$, $75_P$. Moreover, a plurality of the shroud edge passage outlets 172 may be provided to either one or more of the shroud edge passages $75_L$, $75_T$, $75_N$, $75_P$.

The shroud main body 72 comprises a radially inner wall 81 and a radially outer wall 82 opposite to the radially inner wall 81. The shroud main body 72 contains a hollow space S inside thereof between the radially inner wall 81 and the radially outer wall 82. The radially inner surface of the inner wall 81 constitutes the gas path surface 78 of the outer shroud 70. The radially inner wall 81 constitutes a part of the shroud main body 72. The radially inner wall 81 may be continuously extended outward to constitute a part of the shroud edge 74. FIG. 4 describes, as an embodiment, that the radially inner wall 81 is continuously extended outward to constitute a part of the trailing-side shroud edge $74_T$. The shroud main body 72 contains an impingement plate 73 that partitions the space S of the outer shroud 70 into an outer region on the radially outer side and an inner region (cavity) that is a region on the radially inner side. The outer region is connected to the shroud edge passage outlet 172 such that part of cooling air flows from the trailing-side shroud edge passage $75_T$ into the outer region. The inner region is defined between the impingement plate 73 and the radially inner wall 81 of the outer shroud 70.

In the impingement plate 73, a plurality of air holes 79 are provided to extend through the impingement plate 73 in the radial direction. Part of cooling air present in the outer region flows into the inner cavity through the air holes 79 of the impingement plate 73. The cooling air is jetted from air holes 79 toward a radially outer surface of the radially inner wall 81 for impingement cooling of the radially outer surface of the radially inner wall 81, and then, is ejected through the radially outer wall 82 toward the outer side of the outer wall 82. For example, the cooling air is jetted from air holes 79 toward a radially outer surface of the radially inner wall 81 for impingement cooling of the radially outer surface of the radially inner wall 81, and then, is ejected through a passage which connects the inner region (cavity) of the hollow space(S) and an outside space located on the opposite side of the radially outer wall 82 with respect to the hollow space (S). Such a passage may be isolated from the outer region of the hollow space (S). More specifically, in this embodiment, the cooling air is ejected through a hole of an exit conduit 83. The exit conduit 83 is provided to penetrate through the radially outer wall 82 and the impingement plate 73 to connect the inner region and the outside space.

Inside of the vane body 51 is partitioned by radially extending partition walls $51_P$ into a plurality of partitioned regions 141, 142, 143. A plurality of inserts 151, 152, 153 are inserted into the respective partitioned regions 141, 142, 143. The plurality of inserts 151, 152, 153 which include respective radially extending air channels 161, 162, 163 extend in the radial direction from the outer shroud 70 through the vane body 51 to the inner shroud 60. Each of the inserts 151, 152, 153 is formed continuously from the outer shroud 70 through the vane body 51 to the inner shroud 60. Each of the air channels 161, 162, 163 has an air inlet 58 open to the inside of an intake manifold 56.

Each of the inserts 151, 152, 153 has a plurality of apertures (through holes) 59 communicated with the respective air channels 161, 162, 163. Part of cooling air which is supplied to the air channels 161, 162, 163 of the inserts 151, 152, 153 is jetted from the plurality of apertures 59 toward an inner surface of the vane body 51 for impingement cooling of the inner surface of the airfoil 51. The plurality of partitioned regions 141, 142, 143 have respective outer air channels defined between the inserts 151, 152, 153 and the inner surface of the vane body 51. The part of cooling air which is jetted through the apertures 59 is guided by and flows through the outer air channels in the radially outer direction, in the radially inner direction, or in both the radially outer and inner directions through the outer air channels. As an example, FIG. 5 shows the outer air channel 57 between the side surface of the insert 151 and the inner surface of the leading end part of the vane body 51.

The intake manifold 56 and the exit conduit 83 are connected to a forced air cooling system in which cooling air extracted from an inside of a combustor casing is cooled by an external cooler (not shown), and then, compressed by an external compressor (not shown). The compressed air is used for cooling and then returned to the inside of the combustor casing. In the above-description, the air cooling system is applied to the present embodiment. However, the present stator vane is not limited to such embodiment. The present disclosure may be applied to other type of cooling system. For example, the intake manifold 56 and the exit conduit 83 may be connected to a closed-loop steam cooling system or closed-loop air cooling system.

For example, in the insert 151 which is a leading end insert, part of cooling air which is supplied to the air channel 161 through the air inlet 58 is jetted toward the inner surface of the leading end part of the airfoil 51, and then flows in the radially outer direction through the outer air channel 57. The outer air channel 57 which is a space between the insert 151 and the inner surface of the leading end part of the vane body 51 is communicated with the shroud edge passage inlet 171 of the leading-side shroud edge passage $\mathbf{75}_L$. The part of cooling air which is jetted toward the inner surface of the leading end part of the airfoil 51 flows into the shroud edge passage inlet 171 of the leading-side shroud edge passage $\mathbf{75}_L$ through the outer air channel 57 and the air passage.

In the present embodiment, in the insert 151 which is a leading end insert, part of cooling air which is jetted toward the inner surface of the leading end part of the airfoil 51 flows in the radially outer direction through the outer air channel 57. However, the structure of the stator vane is not limited to this embodiment. In the insert 151 which is a leading end insert, part of cooling air which is jetted toward the inner surface of the leading end part of the airfoil 51 may flow in the radially inner direction through the outer air channel 57, or in both the radially inner direction and the radially outer direction.

Figure 7:
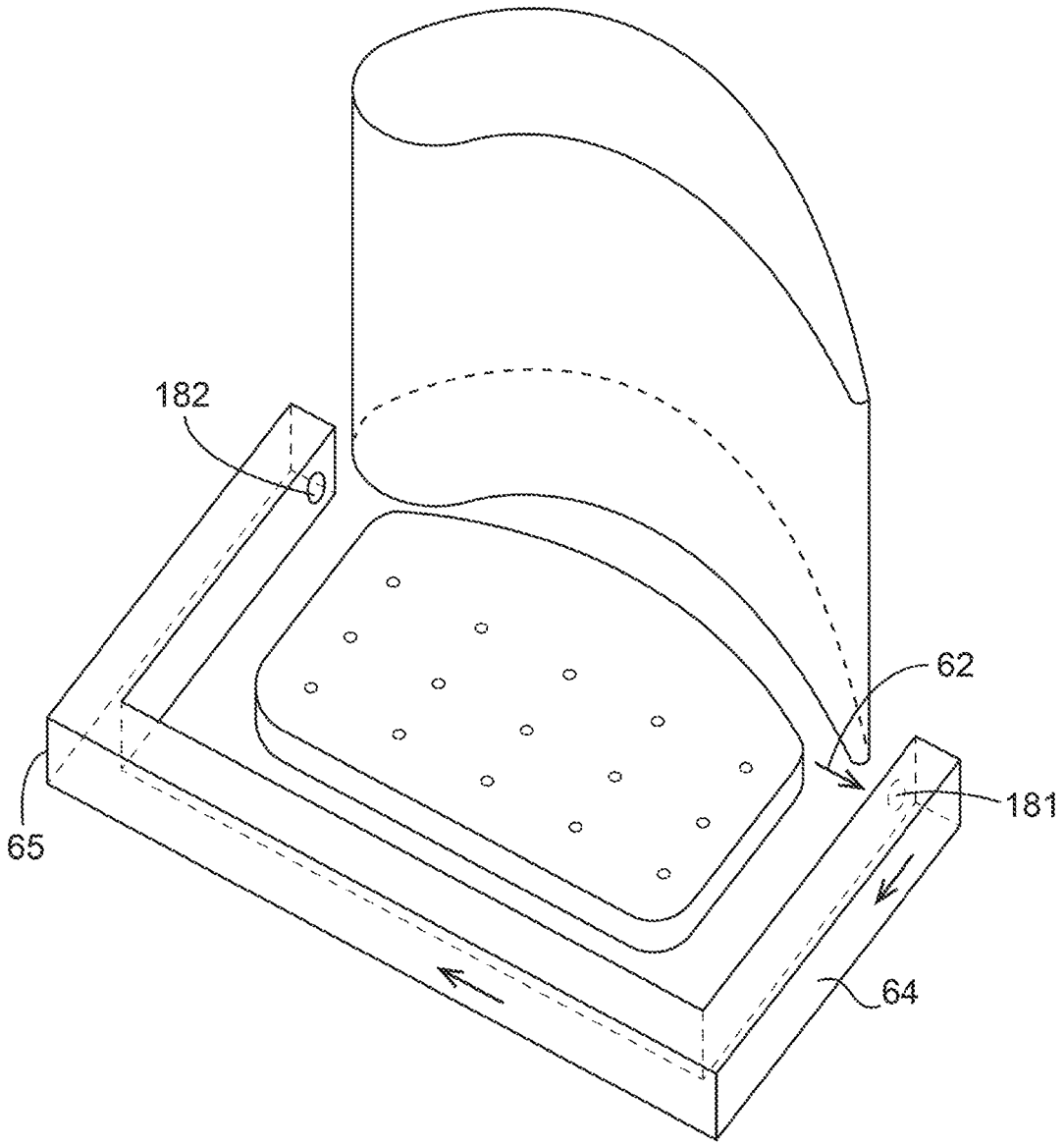
FIG. 7 is a perspective view of a part of a stator vane in the first embodiment.

FIG. 7 is a perspective view of a part of a stator vane in the first embodiment. For example, in the insert 152 which is a middle insert, part of cooling air which is supplied to the air channel 162 through the air inlet 58 is jetted toward the inner surface of the middle part of the airfoil 51, and then flows in the radially inner direction through the outer air channel toward the inner shroud 60, then, as shown by FIG. 7, flows into the shroud edge passage inlet 181 of the inner shroud 60 (disposed on a trailing-side shroud edge). The cooling air then flows through the shroud edge passage 65 of the inner shroud 60 to cool the shroud edge 64 of the inner shroud 60, and then, flows into the shroud main body 62 of the inner shroud 60 through the shroud edge passage outlet 182 of the inner shroud 60 (disposed on a leading-side shroud edge passage). In similar manner to the outer shroud 70, the cooling air is jetted from the air holes of the impingement plate 63 to cool the radially outer wall of the inner shroud 60 which has a gas path surface facing radially outer side and facing the hot gas path.

In some embodiments of this disclosure, as shown by FIG. 4, the airfoil 51 includes a second airfoil cooling structure 154 which includes a passage inside of which a plurality of the pin fins 164 are disposed. In the second airfoil cooling structure 154, part of cooling air flows downstream through the passage with the pin fins 164, and then, is ejected to the hot gas passage at the trailing edge 53 of the airfoil 51.

Cooling Method

Figure 8:
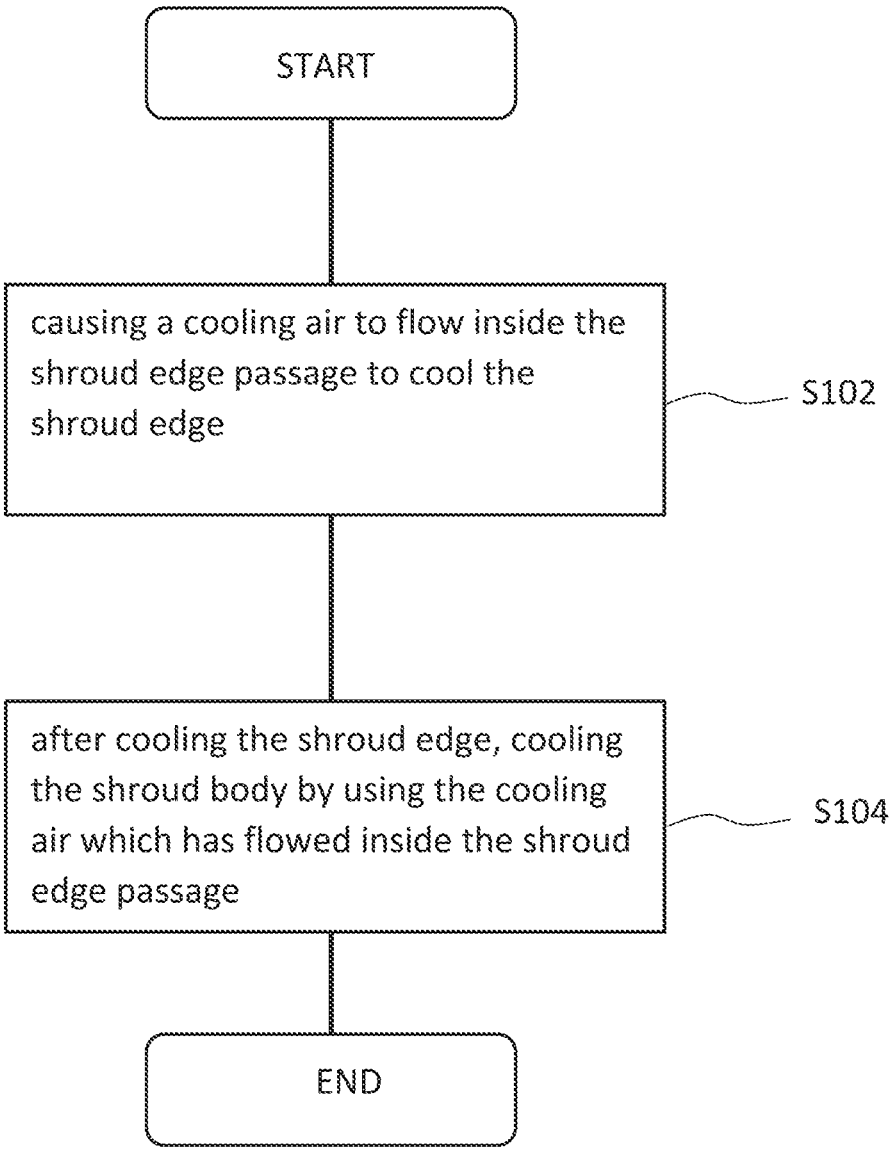
FIG. 8 is a flowchart illustrating a cooling method of the stator vane of the first embodiment.

Next, a cooling method of a stator vane of the first embodiment is described. FIG. 8 is a flowchart illustrating a cooling method of the stator vane of the first embodiment. As shown by FIG. 8, at a step S102, part of cooling air is caused to flow into the shroud edge passage 75 through the shroud edge passage inlet 171. The cooling air flows along and through the shroud edge passage 75 to cool the shroud edge 75.

At a step S104, the cooling air flows into the outer region of the shroud main body 72 and is jetted through the air holes 79 toward the radially outer surface of the radially inner wall 81 for impingement cooling of the radially outer surface of the radially inner plate 81 to cool the shroud main body 72.

Figure 9:
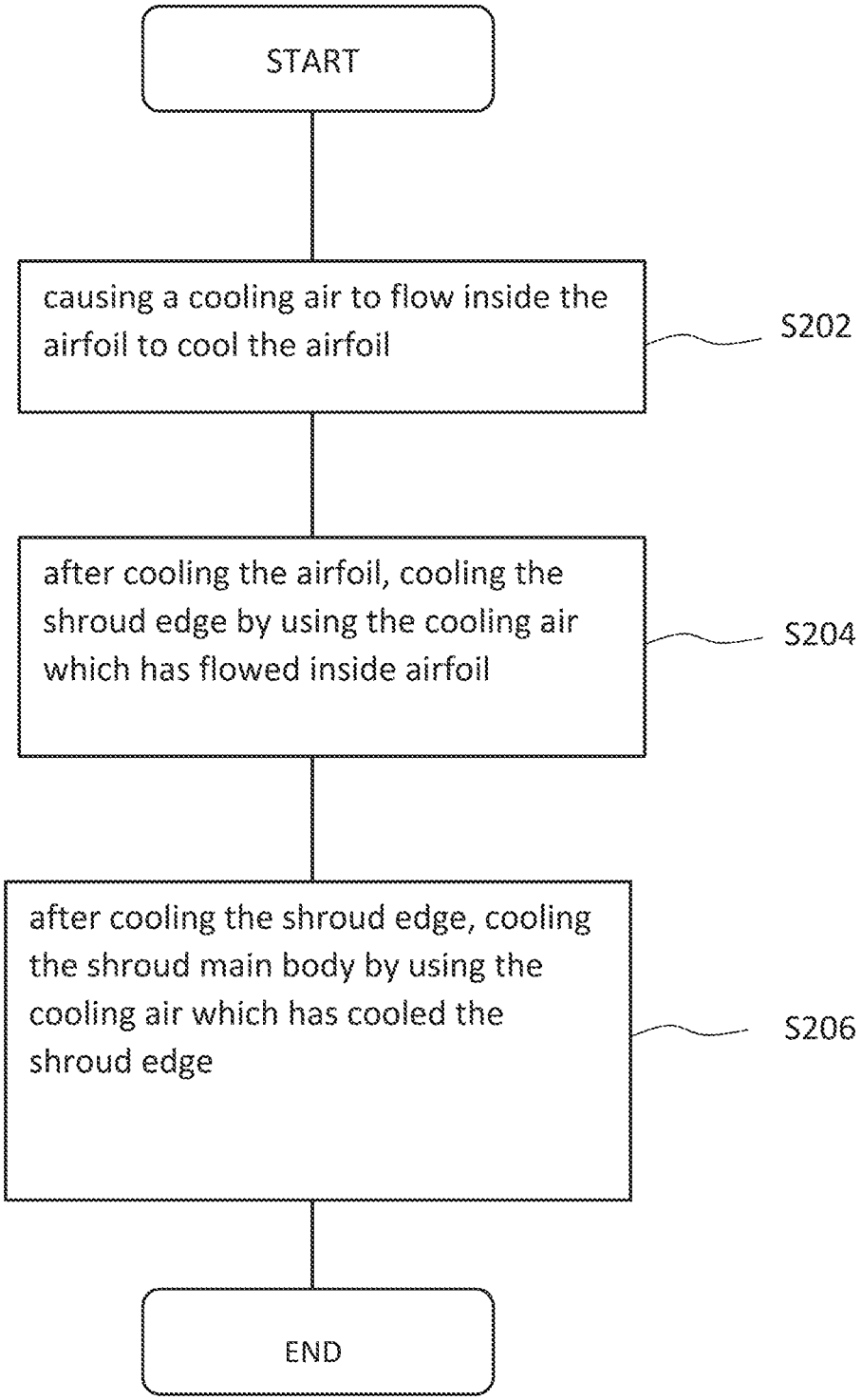
FIG. 9 is a flowchart illustrating a cooling method of the stator vane of the second embodiment.
Figure 10:
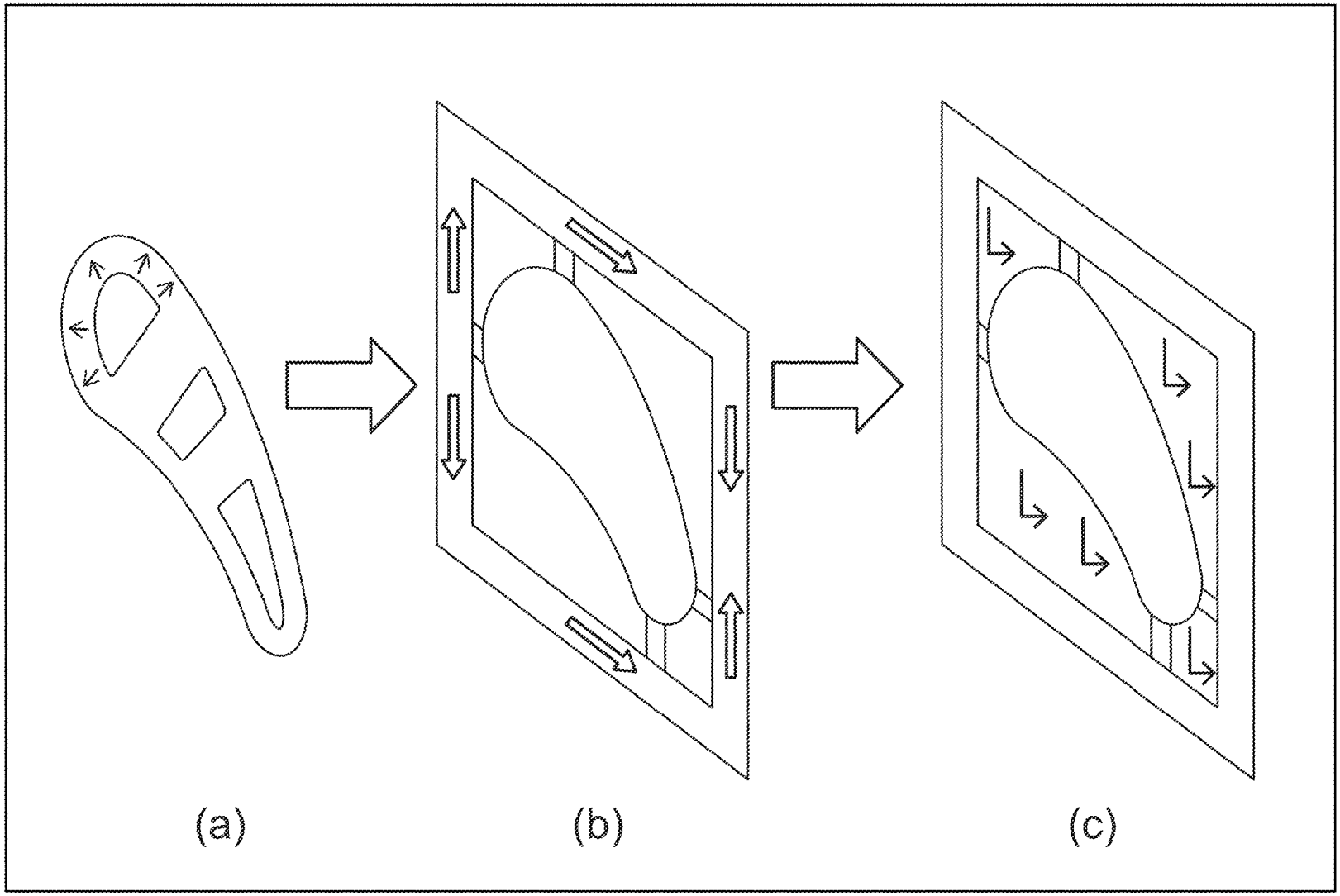
FIG. 10 schematically illustrates cooling steps of the second embodiment.

Next, a cooling method of a stator vane of second embodiment is described. FIG. 9 is a flowchart illustrating a cooling method of the stator vane of the second embodiment. FIG. 10 schematically illustrates cooling steps of the second embodiment. As shown by FIG. 9 and FIG. 10(*a*), at a step S202, part of cooing air from the forced air cooling system is caused to flow into the air channel 161 of the insert 151 through the air inlet 58. The cooling air is then jetted through the apertures 59 toward the inner surface of the leading end part of the airfoil 51 to cool the airfoil 51, and then, flows in the radially outer direction through the outer air channel 57.

As shown by FIG. 10(*b*), at a step S204, the cooling air is caused to flow into the shroud edge passage 75 through the shroud edge passage inlet 171. The cooling air flows along and through the shroud edge passage 75 to cool the shroud edge 75.

As shown by FIG. 10(*c*), at a step S206, the cooling air flows into the outer region of the shroud main body 72 and is jetted through the air holes 79 toward the radially outer surface of the radially inner wall 81 for impingement cooling of the radially outer surface of the radially inner plate 81 to cool the shroud main body 72.

Figure 11:
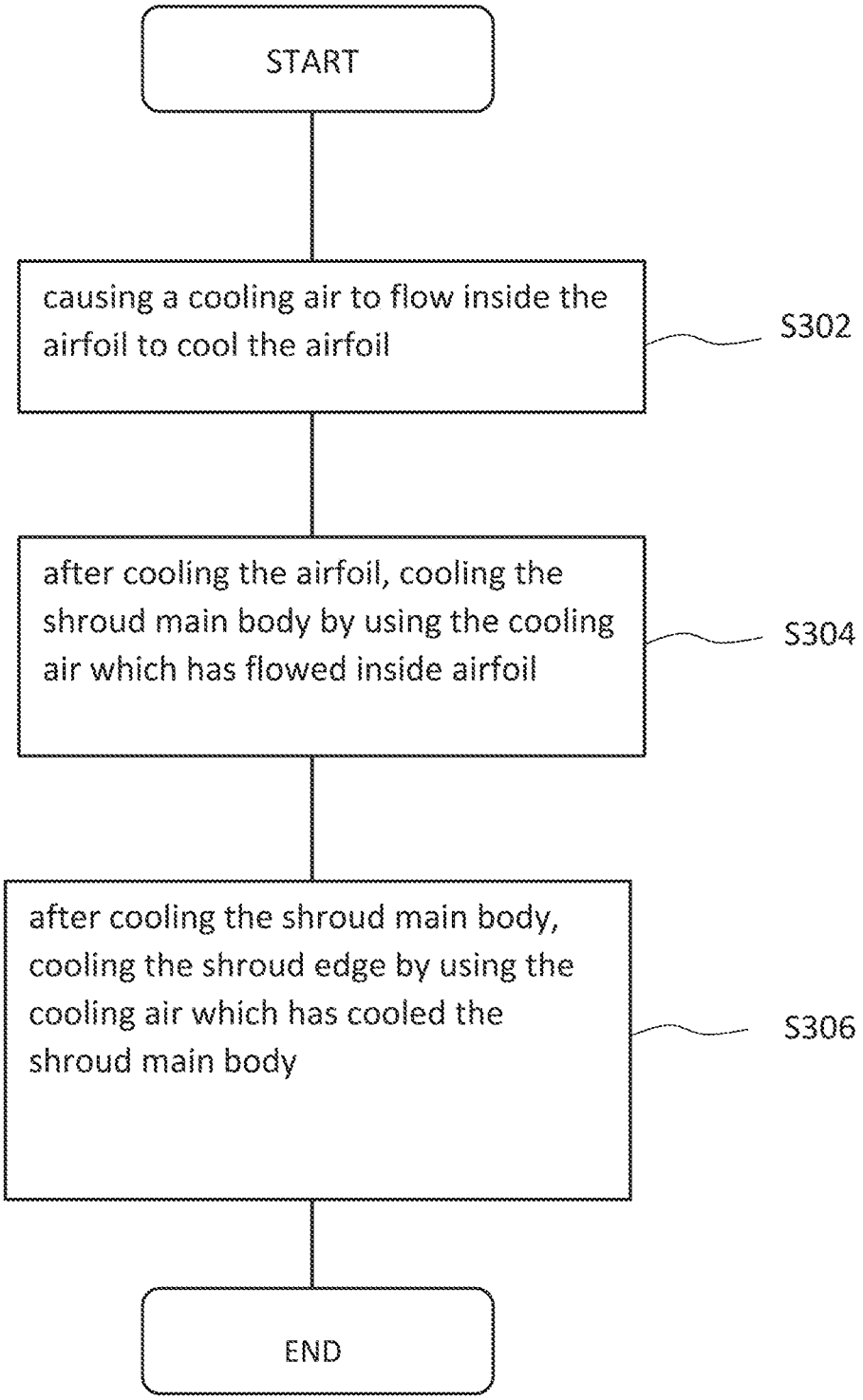
FIG. 11 is a flowchart illustrating a cooling method of the stator vane of the third embodiment.

Next, a cooling method of a stator vane of third embodiment is described. FIG. 11 is a flowchart illustrating a cooling method of the stator vane of the third embodiment. As shown by FIG. 11, at a step S302, part of cooing air from the forced air cooling system is caused to flow into the air channel of the insert through the air inlet. The cooling air is then jetted through the apertures toward the inner surface of the leading end part of the airfoil to cool the airfoil, and then, flows in the radially outer direction through the outer air channel.

At a step S304, the cooing air is caused to flow into the outer region of the shroud main body and is jetted through the air holes toward the radially outer surface of the radially inner wall for impingement cooling of the radially outer surface of the radially inner wall to cool the shroud main body.

At a step S306, the cooing air is caused to flow into shroud edge passage through the shroud edge passage inlet. The cooling air flows along and through the shroud edge passage to cool the shroud edge. The cooling air is returned to the forced air cooling system through the shroud edge passage outlet.

Figure 12:
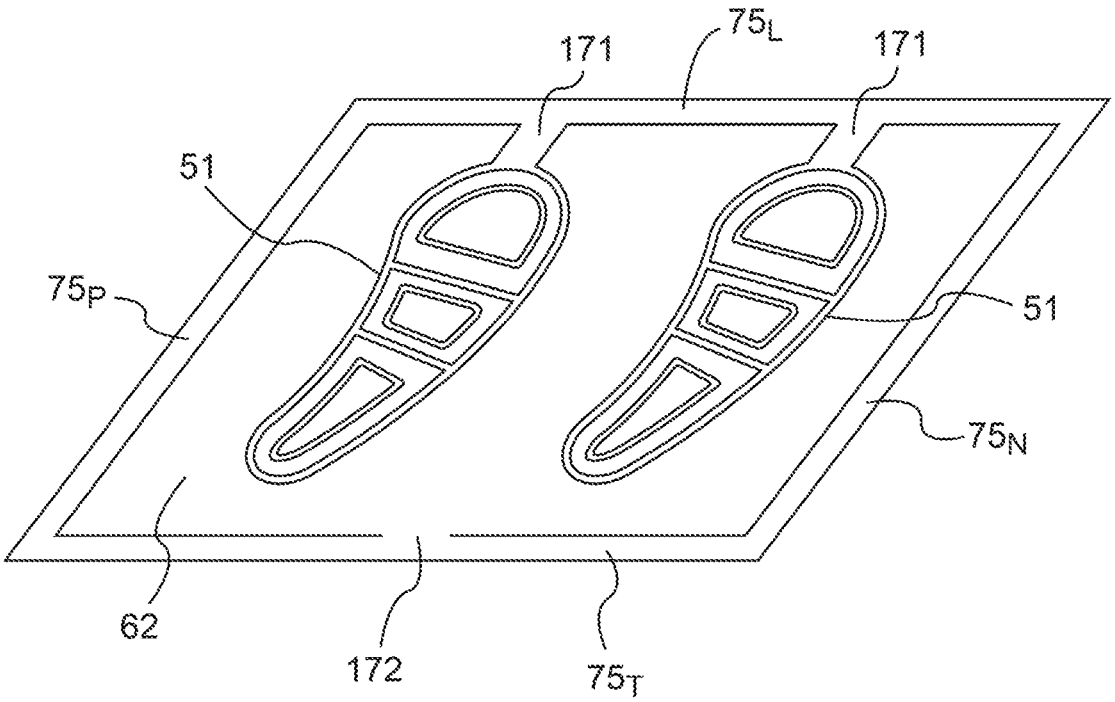
FIG. 12 is a schematic sectional view of a stator vane according to the fourth embodiment.

Next, the fourth embodiment of the present application is described below. FIG. 12 is a schematic sectional view of a stator vane according to the fourth embodiment. As shown by FIG. 12, in the fourth embodiment, a plurality of the airfoils 51 (two airfoils in this embodiment) are surrounded by the shroud edge passages $\mathbf{75}_L$, $\mathbf{75}_T$, $\mathbf{75}_N$, $\mathbf{75}_P$. Differently from the first embodiment (FIG. 5), two shroud edge passage inlets 171 are provided to the leading-side shroud edge passage $\mathbf{75}_L$.

The respective outer air channels which is a space between the insert 151 and the inner surface of the leading end part of the two airfoils 51 are communicated with the respective shroud edge passage inlets 171 of the leading-side shroud edge passage $\mathbf{75}_L$ through the respective air passages provided in an outer end of the respective outer air channels of the respective airfoils 51. The cooing air flows into the leading-side shroud edge passage $\mathbf{75}_L$ through the respective shroud edge passage inlets 171 and flows through the suction-side shroud edge passage $\mathbf{75}_N$, or the pressure-side shroud edge passages $\mathbf{75}_P$, then flows into the outer region of the shroud main body 72 through the shroud edge passage outlet 172.

The present disclosure is not limited to the above-described embodiment and can be implemented in various embodiments. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

10 gas turbine
20 turbine
22 turbine casing
24 rotor shaft
26 turbine rotor
Ar Axis
30 combustor
50 stator vane
51 vane body (airfoil)
51$_P$ partition walls
141, 142, 143 partitioned region
52 leading edge
53 trailing edge
54 suction-side surface
55 pressure-side surface
56 intake manifold
57 outer air channel
58 air inlet
59 apertures
151, 152, 153 insert
161, 162, 163 air channel
154 second airfoil cooling structure
164 pin fin
60 inner shroud
70 outer shroud
72 shroud main body
73 impingement plate
74 shroud edge
75 shroud edge passage
S hollow space
171 shroud edge passage inlet
172 shroud edge passage outlet
175 turbulator
76 peripheral wall
78 gas path surface
79 air holes
81 radially inner wall
82 radially outer wall
83 exit conduit
181 shroud edge passage inlet
182 shroud edge passage outlet

What is claimed is:

1. A vane for a turbine comprising
an airfoil; and
a shroud disposed at an end of the airfoil, the end being a radial end along a radial direction of the turbine,
wherein the shroud comprises:
a shroud main body comprising a first wall facing a hot gas passage of the turbine, a second wall disposed on an opposite side of the first wall with respect to the hot gas passage, and
a shroud edge disposed on a circumference of the shroud main body to surround the shroud main body, the shroud edge comprising a shroud edge passage therein,
wherein the shroud edge comprises a cooling air inlet to introduce a cooling air into the shroud edge passage and a cooling air outlet to cause the cooling air to flow out of the shroud edge passage,
wherein the shroud main body comprises a hollow space inside thereof between the first wall and the second wall, the hollow space being connected with the shroud edge passage through the cooling air outlet.

2. The vane of the turbine according to claim 1, wherein the shroud main body comprises:
an impingement plate disposed between the first wall and the second wall to partition the hollow space into an first region on the first wall side of the impingement plate and an second region on the second wall side of the impingement plate, the second region of the hollow space being connected with the shroud edge passage through the cooling air outlet, and the impingement plate including a plurality of air holes therethrough in the radial direction, and
a passage connecting the first region of the hollow space and an outside space on the opposite side of the second wall with respect to the hollow space, and the passage being isolated from the second region of the hollow space.

3. The vane of the turbine according to claim 2, wherein the passage is configured to penetrate through the second wall and the impingement plate.

4. The vane of the turbine according to claim 2, wherein the passage is configured to bypass the second wall.

5. The vane of the turbine according to claim 2, wherein the shroud main body includes:
an exit conduit extending in the radial direction,
wherein the exit conduit includes the passage inside thereof.

6. The vane of the turbine according to claim 1, wherein the shroud edge comprises:
a leading-side shroud edge including a leading-side shroud edge passage inside thereof,
a trailing-side shroud edge including a trailing-side shroud edge passage inside thereof,
a suction-side shroud edge including a suction-side shroud edge passage inside thereof, and,
a pressure-side shroud edge including a pressure-side shroud edge passage inside thereof,
wherein the cooling air inlet is disposed on one of the leading-side shroud edge and the trailing-side shroud edge, and the cooling air outlet is disposed on either one of the suction-side shroud edge, the pressure-side shroud edge, or the other one of the leading-side shroud edge and the trailing-side shroud edge.

7. The vane of the turbine according to claim 6, wherein the cooling air outlet is disposed on the other one of the leading-side shroud edge and the trailing-side shroud edge.

8. The vane of the turbine according to claim 1, wherein the shroud edge passage includes:
a turbulator disposed on an inner surface of the shroud edge passage.

9. The vane of the turbine according to claim 8, wherein the turbulator is disposed on a bottom surface of the shroud edge passage which is the closest surface to the hot gas passage of the turbine among a plurality of inner surfaces defining the shroud edge passage.

10. The vane of the turbine according to claim 1, wherein the cooling air inlet is communicated with an inside of the airfoil, and is configured to introduce the cooling air from the airfoil to the shroud edge passage.

11. The vane of the turbine according to claim 10, wherein the airfoil includes:

a radially extending insert comprising a radially extending air channel inside thereof and an aperture penetrating through a side wall of the insert from an inner side surface thereof to an outer side surface thereof, and an outer air channel between an inner side surface of the airfoil and the outer side surface of the insert, wherein the outer air channel is connected to the cooling air inlet such that a cooling air is introduced to the air channel and is jetted through the aperture from the air channel toward the inner side surface of the airfoil and guided by the outer air channel toward the cooling air inlet.

12. The vane of the turbine according to claim 2, wherein the cooling air inlet of the shroud edge is configured to receive a cooling air extracted from an inside of a combustor casing and compressed by an external compressor, and the passage is configured to discharge the cooling air to the inside of the combustor casing.

13. The vane of the turbine according to claim 1, wherein the shroud edge surrounds the shroud main body entirely, and the cooling air flows along entirety of the shroud edge.

14. A method of cooling a vane of a turbine, the turbine comprising an airfoil, a shroud disposed at an end of the airfoil, the end being a radial end along a radial direction of the turbine, the shroud comprising a shroud main body and a shroud edge disposed on a circumference of the shroud main body to surround the shroud main body, the shroud edge comprising a shroud edge passage therein, wherein the method comprising steps of:

(i) causing a cooling air to flow inside the shroud edge passage to cool the shroud edge; and (ii) after cooling the shroud edge, cooling the shroud main body by using the cooling air which has flowed inside the shroud edge passage.

15. The method of cooling the vane of the turbine according to claim 14, further comprising:

causing the cooling air to flow inside the airfoil to cool the airfoil, and wherein the step (i) further comprises causing the cooling air to flow inside the shroud edge passage to cool the shroud edge by using the cooling air which has flowed inside the airfoil after cooling the airfoil.

16. The method of cooling the vane of the turbine according to claim 15, wherein the airfoil includes:

a radially extending insert comprising a radially extending air channel inside thereof, wherein the cooling air is introduced to the air channel to cool the airfoil, and then, is guided by the airfoil toward the shroud edge passage.

17. The method of cooling the vane of the turbine according to claim 15, wherein the airfoil includes:

a radially extending insert comprising a radially extending air channel inside thereof and an aperture penetrating through a side wall of the insert from an inner side surface thereof to an outer side surface thereof, and an outer air channel between an inner side surface of the airfoil and the outer side surface of the insert, wherein the cooling air is introduced to the air channel and is jetted through the aperture from the air channel toward the inner side surface of the airfoil and guided by the outer air channel toward the shroud edge passage.

18. The method of cooling the vane of the turbine according to claim 16, wherein the radially extending air channel of the insert is configured to receive a cooling air extracted from an inside of a combustor casing and compressed by an external compressor, and the method further comprises, after cooling the shroud main body, discharging the cooling air to the inside of the combustor casing.

19. The method of cooling the vane of the turbine according to claim 14, wherein the shroud edge comprises:

a leading-side shroud edge including a leading-side shroud edge passage inside thereof, a trailing-side shroud edge including a trailing-side shroud edge passage inside thereof, a suction-side shroud edge including a suction-side shroud edge passage inside thereof, and, a pressure-side shroud edge including a pressure-side shroud edge passage inside thereof, wherein the step (i) further comprises:

causing the cooling air to flow inside the shroud edge passage to cool the shroud edge by using the cooling air which has been introduced from one of the leading-side shroud edge and the trailing-side shroud edge, and wherein the step (ii) further comprises cooling the shroud main body by using the cooling air which has flowed inside the shroud edge passage and has been discharged from either one of the suction-side shroud edge, the pressure-side shroud edge, or the other one of the leading-side shroud edge and the trailing-side shroud edge.

20. A method of cooling a vane of a turbine, the turbine comprising an airfoil, a shroud disposed at an end of the airfoil, the end being a radial end along a radial direction of the turbine, the shroud comprising a shroud main body and a shroud edge disposed on a circumference of the shroud main body to surround the shroud main body, the shroud edge comprising a shroud edge passage therein, wherein the method comprising steps of:

(i) causing a cooling air to flow inside the airfoil to cool the airfoil;

(ii) after cooling the airfoil, cooling either one of the shroud main body or the shroud edge by using the cooling air which has flowed inside airfoil; and (iii) after cooling either one of the shroud main body or the shroud edge, cooling the other one of the shroud main body or the shroud edge by using the cooling air which has cooled either one of the shroud body or the shroud edge.

* * * * *